US007363862B2

(12) United States Patent
Gilliam et al.

(10) Patent No.: US 7,363,862 B2
(45) Date of Patent: Apr. 29, 2008

(54) MULTI-PURPOSE SINGLE INITIATED TANDEM WARHEAD

(75) Inventors: Jason C. Gilliam, Harvest, AL (US); Darin L. Kielsmeier, Huntsville, AL (US)

(73) Assignee: United States of America as represented by the Secretary of the Army, Washington, DC (US)

( * ) Notice: Subject to any disclaimer, the term of this patent is extended or adjusted under 35 U.S.C. 154(b) by 379 days.

(21) Appl. No.: 11/139,909

(22) Filed: May 27, 2005

(65) Prior Publication Data

US 2006/0266247 A1 Nov. 30, 2006

(51) Int. Cl.
*F42B 12/16* (2006.01)

(52) U.S. Cl. ..... 102/476; 102/491

(58) Field of Classification Search ..... 102/476, 102/475, 473, 491, 492, 493, 494
See application file for complete search history.

(56) References Cited

U.S. PATENT DOCUMENTS 3,129,665 A * 4/1964 Evans, Jr. ..... 102/476
3,416,449 A * 12/1968 Brothers ..... 102/476
4,111,126 A * 9/1978 Thomanek ..... 102/476
4,466,353 A * 8/1984 Grace ..... 102/307
4,714,022 A 12/1987 Chaumeau et al.
5,166,469 A 11/1992 Kerdraon et al.
5,198,615 A * 3/1993 Robbie et al. ..... 102/476
5,247,887 A * 9/1993 Drimmer ..... 102/399
5,309,843 A 5/1994 Rentzsch et al.
5,415,105 A 5/1995 Voss et al.
5,561,261 A 10/1996 Lindstadt et al.
5,565,648 A 10/1996 Lindstadt et al.
5,594,197 A 1/1997 Lindstadt et al.
5,744,746 A 4/1998 Tripptrap et al.
6,109,185 A 8/2000 Mikhail

* cited by examiner

*Primary Examiner*—James S Bergin
(74) *Attorney, Agent, or Firm*—Michael K. Gray

(57) ABSTRACT

A multi-purpose tandem warhead needing only a single initiation has a casing that forms front, middle and rear portions. A shaped charge is positioned in the rear portion of the casing and a fragmentation charge is positioned in the front portion of the casing. The middle portion between the front and rear portions is an open area that serves as a jet formation region. An impact switch is positioned at the front of the warhead. Upon impact with a target the impact switch sends a detonation signal to a detonator positioned at the rear end of the warhead causing the shaped charge to initiate. Upon the detonation of the rear shaped charge, a high-speed shaped-charge jet forms into the hollow jet formation region, penetrates into and initiates the forward fragmentation charge, and continues through the fragmentation charge. The residual shaped charge jet provides lethality against light armored targets while the fragmentation from the forward charge provides lethality against personnel and other soft targets.

6 Claims, 3 Drawing Sheets

MULTI-PURPOSE SINGLE INITIATED TANDEM WARHEAD

DEDICATORY CLAUSE

The invention described herein may be manufactured, used and licensed by or for the U.S. Government for governmental purposes without payment of any royalties thereon.

BACKGROUND OF THE INVENTION

I. Field of the Invention

The present invention pertains to tandem warheads. More particularly the present invention pertains to a tandem warhead that requires only a single initiation mechanism.

II. Discussion of the Background

Tandem warheads refer to warheads having two explosive charges. Typically, each charge is utilized for a specific lethal effect. Conventional tandem warheads have two initiation mechanisms. Typically the forward charge is initiated first with a second warhead being initiated after a prescribed time delay. In anti-armor warhead systems, the shaped charge is the most common kill mechanism. However, typical shaped-charge warheads do not have adequate fragmentation characteristics to be effective against personnel and other soft targets.

The need for two initiating mechanisms or fuzes in the conventional tandem warhead augments the cost and complexity of such devices and increases the likelihood of initiation failure.

SUMMARY OF THE INVENTION

The present invention utilizes a single initiation mechanism to activate the two respective explosive charges in the tandem warhead. This single initiation mechanism increases reliability while reducing the complexity and cost of the warhead.

In addition, the present invention utilizes a shaped-charge in the rear of the warhead sub-system as both an armor piercing kill mechanism and an initiation device for the forward fragmentation charge. Further, an explosive charge positioned at the front of the warhead sub-system acts as a fragmentation charge thereby providing desirable fragmentation effects for the warhead sub-system.

Accordingly, one object of the present invention is to provide a tandem warhead that requires only one initiation mechanism.

Another object of the present invention is to provide for a tandem warhead that combines armor piercing capability with lethal fragmentation capabilities.

These and other objects of the present invention are realized by a tandem warhead sub-system having a casing that has a forward portion, a middle portion and a rear portion. A frontal explosive fragmentation charge is positioned within the forward portion of the casing and a shaped charge is positioned within the rear portion of the casing.

A shaped charge jet formation region is located between the shaped charge and the frontal explosive fragmentation charge. The jet formation region is an open region within the middle portion of the casing. A detonating means or mechanism is positioned behind the shaped charge to initiate the shaped charge. A signal generating means or target detection device is provided for sending a detonation signal to the detonating means upon impact with a target.

Upon the detonating means receiving the detonation signal, detonation of the shaped charge occurs resulting in the collapse of the metallic shaped charge liner and formation of a high speed metallic jet in the jet formation region so as to penetrate and cause the initiation of the frontal explosive charge. The frontal explosive charge is a fragmentation charge. Fragmentation material in the forward portion of the metallic fragmenting casing is sprayed as a result of the fragmentation charge, i.e., the frontal explosive charge, being initiated.

At the detonation of the frontal explosive charge, the shaped charge jet generated by the shaped charge has so penetrated and initiated the frontal explosive charge that a residual portion of the jet continues forward in front of the frontal explosive charge thus providing armor-piercing capability to the warhead.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION

Figure 1:
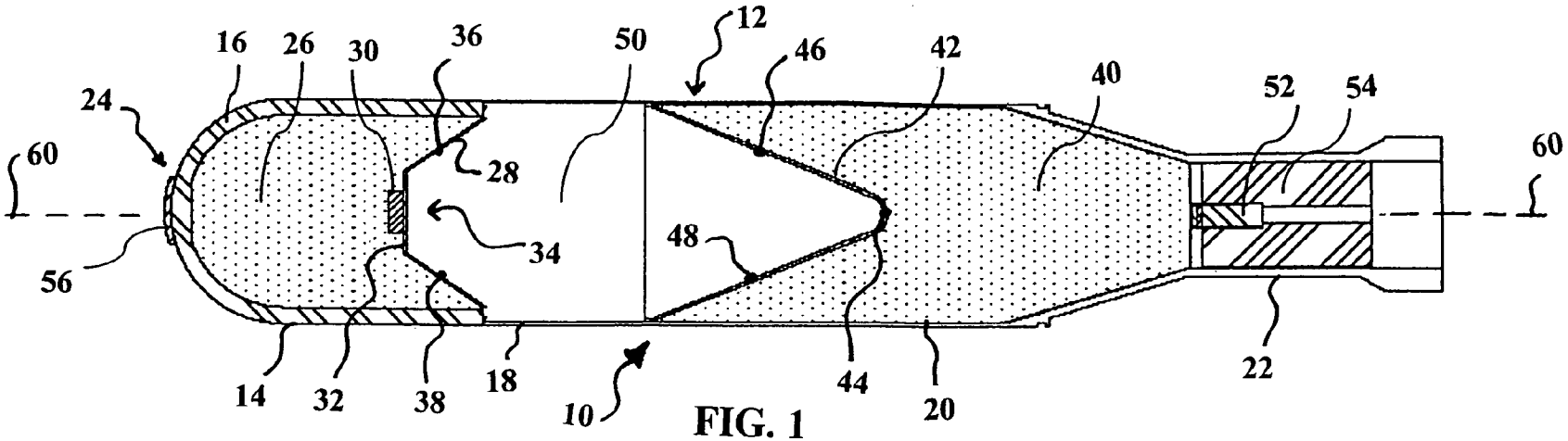
FIG. 1 is a see-through side view of the tandem warhead of the present invention.

Referring now to the drawings wherein like reference numerals designate identical or corresponding parts, and more particularly to FIG. 1, the single initiated warhead 10 of the present invention is provided with a casing 12 having a forward portion 14, a middle portion 18, and a rear portion 20. The forward portion 14 of casing 12 includes a metallic fragmentation case 16.

At the very front of the warhead 10 is the nose or front end 24 that is a part of the forward portion of the casing. Behind the rear portion 20 of the casing 12 is a rear end region 22.

A frontal or forward explosive charge 26 is positioned within the forward portion 14 of casing 12. The frontal charge 26 is a fragmentation charge. An explosive liner 28 (i.e., frontal explosive liner) in conjunction with the forward portion 14 of casing 12 forms a receptacle that houses the frontal charge 26. The explosive liner 28 is made of a plastic or similarly suitable material. The explosive liner 28 has a platform region 32 that is orthogonal to and is intersected by the center horizontal axis 60 of the warhead 10. Reference numerals 36 and 38 represent points on respective sloped, lateral sides of the explosive liner 28. The explosive liner is generally cup-shaped and forms a hollow inlet 34. A booster charge 30 is positioned on the platform region 32.

Within the rear portion 20 of casing 12 is shaped charge 40. A metallic shaped-charge liner 42 in conjunction with the rear portion 20 of casing 12 forms a shaped-charge housing. The shaped-charge liner 42 of the prototype of the present invention has a conical shape with a center point 44 being the closest point on the liner 42 to the rear end region 22. Reference numerals 46 and 48 represent points on respective, sloped lateral sides of the shaped-charge liner 42. The center point 44 of liner 42 is intersected by the center horizontal axis 60 of the warhead 10.

It is noted that other shapes of liners can be utilized within the concept of the present invention, with these shapes including shaped-charge liners having conical, hemispherical, trumpet, or tulip shapes.

The middle portion 18 of casing 12 is a hollow region that serves as a shaped charge jet formation region 50. An impact switch or sensor 56 is positioned at the nose or front end 24 of the casing 12. Upon impact with a target, a signal from the impact switch 56 is generated to the fuse 54 and detonator 52 located at the rear end 22 of the warhead 10.

Figure 2:
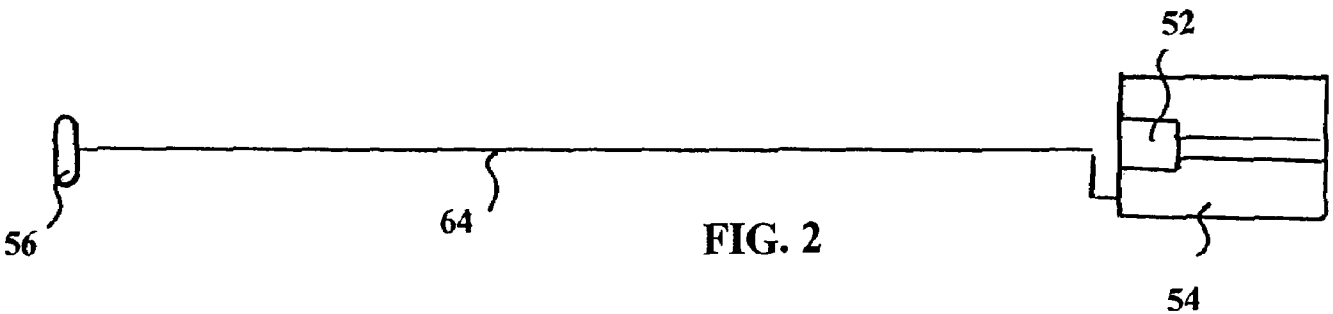
FIG. 2 is a schematic drawing showing that the trigger switch is electrically wired to detonator 52.

Thus, upon a signal from the impact switch 56 being sent to the fuse 54 and detonator 52 the shaped charge 40 is initialized or detonated. An electrical wire or cable 64 connects the trigger switch to the fuse 54 which acts as a safe and arm device (FIG. 2). Immediately after the detonation of shaped charge 40, the explosive causes the metal liner 42 of the shaped charge to converge along the central axis into a shaped charge jet 58 into the jet formation region 50. The shaped charge jet 58 is directed into the inlet region 34 of forward explosive liner 28 and penetrates the explosive liner 28 causing detonation of the booster charge 30 and frontal charge 26.

Figure 3:
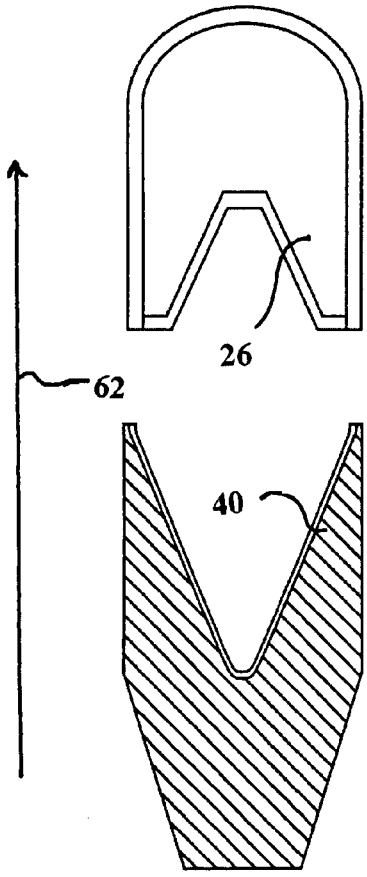
FIG. 3 is a screen shot from a CTH hydrocode analysis illustrating the respective positions of the frontal explosive fragmentation charge and the shaped charge prior to initiation.

With reference to FIG. 3, the shaped charge 40 and frontal charge 26 are shown as positioned after the warhead has been released or fired, but prior to impact. The arrow 62 demonstrates the direction in which the respective charges are moving.

Figure 4:
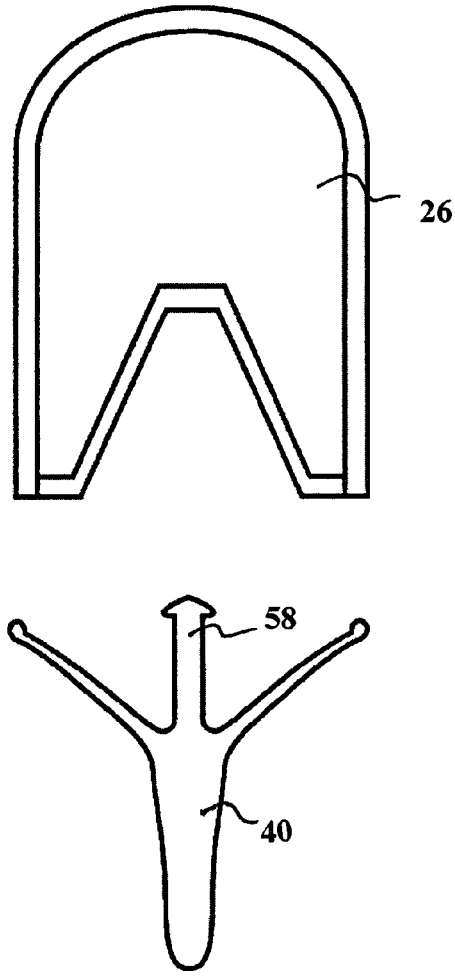
FIG. 4 is a screen shot from a CTH hydrocode analysis illustrating the respective positions of the frontal explosive charge and the shaped charge immediately after initiation.

In FIG. 4, the beginning moment of initiation is depicted with the shaped-charge jet 58 beginning to form and the shaped charge 40 moving in the direction of the frontal charge 26.

Figure 5:
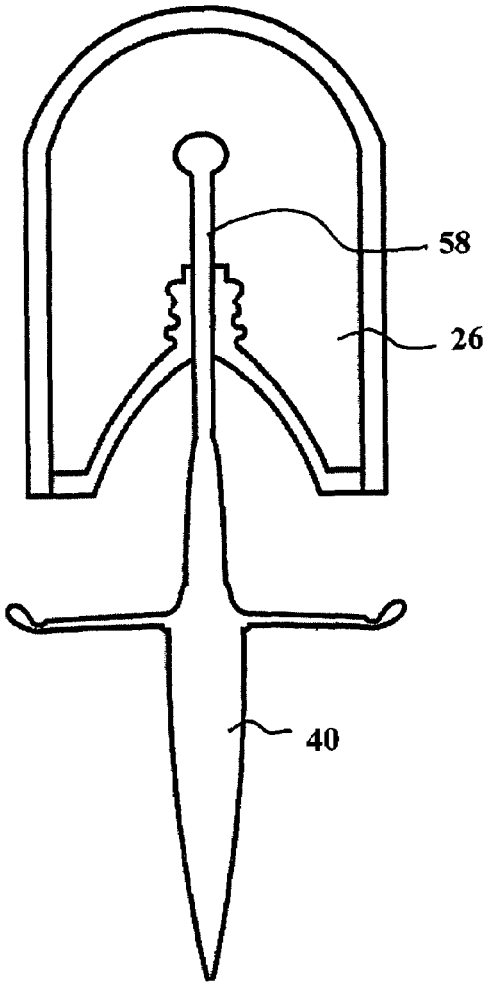
FIG. 5 is a screen shot from a CTH hydrocode analysis illustrating the respective positions of the frontal explosive fragmentation charge and the shaped charge immediately after the time frame shown in FIG. 3.

In FIG. 5 the shaped charge jet 58 has penetrated the frontal charge 26 and the shaped charge 40 has impacted the frontal charge 26.

Figure 6:
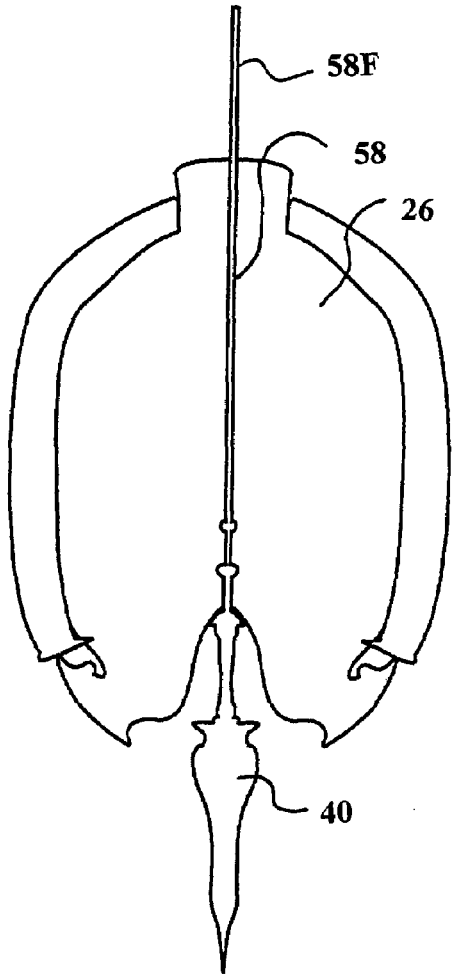
FIG. 6 is screen shot from a CTH hydrocode analysis illustrating the respective positions of the frontal explosive charge and the shaped charge immediately after the time frame shown in FIG. 4.

In FIG. 6 a forward portion 58F of shaped charge jet 58 has totally penetrated the frontal charge 26 and is positioned at the front thereof and the shaped charge 40 has partially combined with the frontal charge. The forward charge portion 58F that is positioned to the front of frontal charge 26 includes metallic particles from the metal shaped-charge liner 42 that have been thrust forward by a shock wave of heat and pressure.

The present invention allows for the utilization of a single warhead in the engagement of a diverse set of targets. Although the performance of the shaped charge 40 is degraded as it penetrates and initiates the forward fragmentation charge 26, CTH hydrocode analyses and preliminary testing have demonstrated that the configuration of the present invention allows for sufficient penetration of lightly armored targets.

Testing has verified that the shaped charge jet 58 would reliably initiate the explosive of the forward fragmentation charge 26 and that the residual shaped charge jet 58F will penetrate light armor. The forward fragmentation charge 26 sprays fragments in a forward direction from 0 to 60 degree polar zones.

Modifications are possible without deviating from the spirit of the present invention. Accordingly the scope of the invention is limited only by the claim language which follows hereafter.

What is claimed is:

1. A tandem warhead, comprising:

a front end and a rear end;

a casing having a forward portion that includes a fragmentation case at said front end, said casing having a middle portion, and said casing having a rear portion that includes said rear end;

a fragmentation charge located within said fragmentation case;

a fragmentation liner that forms a receptacle with said fragmentation case, said fragmentation liner and said fragmentation case surrounding said fragmentation charge;

a shaped charge located at said rear portion of said casing;

a shaped-charge liner that forms a shaped-charge housing with said rear portion of said casing, said shaped charge being located within the shaped-charge housing;

a jet formation region, said jet formation region being located between said fragmentation charge and said shaped charge;

an impact switch positioned at said front end of said warhead; and a single detonator positioned at said rear end of said warhead and being electrically connected to said impact switch; and wherein said fragmentation liner forms a hollow inlet region, said hollow inlet region being intersected by a center longitudinal axis of said warhead.

2. A tandem warhead according to claim 1, wherein said shaped-charge liner has a center point that intersects said center longitudinal axis, said center point being closer to said rear end of said warhead than other points on said shaped-charge liner.

3. A tandem warhead according to claim 2, wherein said shaped-charge liner forms a conical shape.

4. A tandem warhead according to claim 1, wherein upon impact with a target said impact switch sends a signal to said single detonator causing said shaped charge to explode, causing a shaped-charge jet comprised of a shock wave of heat and pressure to be jettisoned into said jet formation region and penetrating said fragmentation charge, and causing said fragmentation charge to detonate.

5. A tandem warhead according to claim 4, wherein at the detonation of said fragmentation charge, a portion of said shaped-charge jet is positioned to the front of said fragmentation charge, said portion of said shaped-charge jet including metal particles from said shaped-charge liner.

6. A tandem warhead according to claim 1, wherein:

a booster charge connects to said fragmentation liner.

* * * * *